US006036509A

United States Patent [19]

Maejima

[11] Patent Number: 6,036,509

[45] Date of Patent: Mar. 14, 2000

[54] LOW INSERTION FORCE CONNECTOR

[75] Inventor: Toshiro Maejima, Hertfordshire, United Kingdom

[73] Assignee: Yazaki Corporation, Tokyo, Japan

[21] Appl. No.: 09/027,676

[22] Filed: Feb. 23, 1998

[30] Foreign Application Priority Data

Mar. 5, 1997 [JP] Japan ..... 9-050273

[51] Int. Cl.[7] ..... H01R 13/62

[52] U.S. Cl. ..... 439/157; 439/310

[58] Field of Search ..... 439/152–160, 439/310, 345, 346, 347

[56] References Cited

U.S. PATENT DOCUMENTS

| | | | |
|---|---|---|---|
| 4,586,771 | 5/1986 | Kraemer et al. | 339/75 |
| 5,478,251 | 12/1995 | Jacklin | 439/157 |
| 5,618,195 | 4/1997 | Cappe | 439/157 |
| 5,876,226 | 3/1999 | Tsukakoshi et al. | 439/157 |

FOREIGN PATENT DOCUMENTS

| | | |
|---|---|---|
| 722 204 | 7/1996 | European Pat. Off. . |
| 195 30 334 | 2/1997 | Germany . |
| 195 32 623 | 3/1997 | Germany . |
| 36 45 179 | 3/1997 | Germany . |
| 4-319271 | 11/1992 | Japan . |

*Primary Examiner*—Lincoln Donovan
*Attorney, Agent, or Firm*—Sughrue, Mion, Zinn Macpeak & Seas, PLLC

[57] ABSTRACT

An LIF connector includes a first connector including a housing having cam projections formed on a side surface thereof, a second connector having a reception portion for receiving the first connector, and a slider having a generally U-shape includes a pair of opposed side walls each having a cam groove for guiding a respective one of the cam projections. When the slider is pushed into the second connector, the slider causes the first connector to be inserted into the second connector. A movable lock portion is pivotally mounted on a distal end of at least one of the opposed side walls of the slider. The lock portion, passed through a housing of the second connector when the slider is inserted into the second connector, is brought into a laid condition, thereby locking the slider to the second connector.

11 Claims, 5 Drawing Sheets

LOW INSERTION FORCE CONNECTOR

BACKGROUND OF THE INVENTION

1. Field of the Invention

This invention relates to an LIF (low insertion force) connector having a slider serving as an LIF mechanism by which a multi-pole connector, having many terminals, can be easily inserted into and withdrawn from a mating multi-pole connector.

2. Background

A multi-pole connector has a plurality of terminals. Therefore, a large insertion/withdrawal force is required for inserting and withdrawing the connector relative to a mating connector, and it has been rather difficult to effect the insertion and withdrawal of the connector. In view of the difficulty of insertion and withdrawal of such a multi-pole connector, there have now been proposed various connectors (LIF connectors) having an LIF mechanism.

A representative example of such LIF connectors includes one in which a connector is inserted and withdrawn by operating a slider.

One such LIF connector with a slider is proposed in Unexamined Japanese Patent Publication No. Hei. 4-319271. FIG. 5 is an exploded, perspective view of the LIF connector.

This LIF connector includes male connectors 111 and 112, a rectangular frame-like holder 120 for receiving the male connectors 111 and 112, a female connector 130 for receiving the male connectors 111 and 112 received in the holder 120, and a slider 140 of a generally U-shape for inserting and withdrawing the male connectors 111 and 112 relative to the connector female 130.

A pair of cam projections 121 and 121 are formed on each of upper and lower surfaces of the holder 120. Insertion holes 131 and 131, in which the slider 140 is inserted, are formed through each of opposite end walls of the female connector 130. A pair of cam grooves 141 and 141, corresponding to the cam projections 121 and 121, are formed in each of upper and lower walls of the slider 140.

In the LIF connector of the above construction, the slider 140 is inserted into a predetermined position in the female connector 130, and the cam projections 121 on the holder 120 are positioned respectively relative to the cam grooves 141 in the slider 140.

Then, when the slider 140 is pushed into the female connector 130, the cam projections 121 on the holder 120 are guided respectively by the cam grooves 141 in the slider 140, so that the male connectors 111 and 112, received in the holder 120, are inserted into the female connector 130.

That is, in this LIF connector, by pushing the slider 140, the male connectors 111 and 112 can be easily inserted into the female connector 130 with a small force.

By withdrawing the slider 140 from the female connector 130, the male connectors 111 and 112 can be withdrawn from the female connector 130.

However, since the above slider-type LIF connector does not have any mechanisms for locking the slider 140 to the female connector 130, the slider 140 is free to move into and out of the female connector 130 before inserting the male connectors 111 and 112 received in the holder 120 into the female connector 130.

Accordingly, it is troublesome to handle an assembly comprising the slider 140 and the female connector 130, and there has been encountered problems that the slider 140 may be lost or damaged during the transport of the assembly and that noises may be produced by the movement of the slider 140 during the transport.

In the above LIF connector, although the male connectors 111 and 112 can be easily inserted into the female connector 130 by pushing the slider 140, it is difficult to withdraw the slider 140 from the female connector 130. Therefore, there has been encountered a problem that considerable time and labor may be required for withdrawing the male connectors 111 and 112 from the female connector 130.

SUMMARY OF THE INVENTION

With the above problems in view, it is an object of this invention to provide an LIF connector in which a slider has a locking member for locking the slider to a female connector, so that an assembly, comprising the slider and the female connector, can be handled easily, and also the loss and damage of the slider, as well as the generation of noises, are positively prevented.

To achieve the above-mentioned object, an LIF connector comprises: a first connector including a housing having cam projections formed on side surfaces thereof; a second connector including a housing having a reception portion into which the first connector is insertable; and a slider including a base portion, and a pair of opposed side walls extending respectively from end portions of the base portion, the opposed side walls being slidably insertable into the housing of the second connector, the opposed side walls having cam grooves which are respectively guidable the cam projections so that the first connector is inserted into the second connector in accordance with movement of the slider, at least one of the opposed side walls having a lock portion pivotably connected to a distal end portion thereof, the lock portion being projectable to pivotably move from the housing of the second connector when inserting the slider into the second connector. In the above LIF connector, the slider can be locked to the second connector as the lock portion is bent in a laid condition after the lock portion is projected to pivotally move from the housing of the second connector.

Preferably, an engagement pawl for engagement with the lock portion in the laid condition is provided on the housing of the second connector.

With this construction, by bringing the lock portion into the laid condition, the slider, inserted in the female connector, can be locked to the female connector, and therefore the assembly, comprising the slider and the female connector, can be handled easily.

Therefore, the loss and damage of the slider, as well as the generation of noises, during the transport of the assembly, are positively prevented.

Where the engagement pawl for engagement with the lock portion in the laid condition is provided on the housing of the second connector, the lock portion can be held in the locked condition, and the accidental disengagement of the slider can be prevented.

DETAILED DESCRIPTION OF THE PREFERRED EMBODIMENT

One preferred embodiment of an LIF connector of the present invention will now be described with reference to the drawings.

Figure 1:
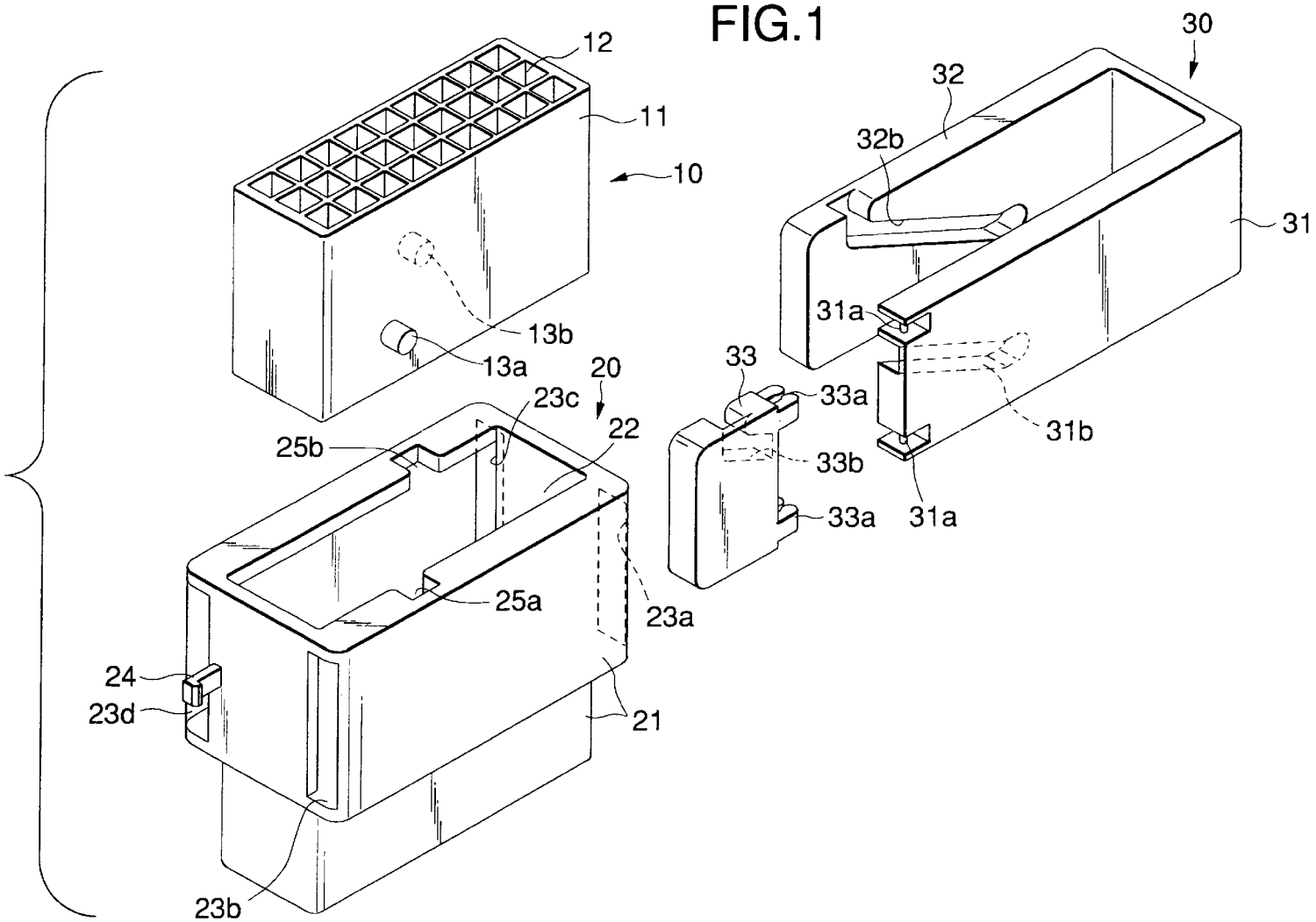
FIG. 1 is an exploded, perspective view of one preferred embodiment of an LIF connector of the present invention.

In FIG. 1, a male connector (first connector) includes a rectangular housing 11 having a plurality of terminal receiving chambers 12. Although not shown in the drawings, female terminals are received respectively in the terminal receiving chambers 12.

Cam projections 13*a* and 13*b* are formed respectively on opposite longitudinal side walls of the housing 11, and are disposed out of registry with each other.

A female connector (second connector) 20 includes a housing 21 having an upper portion serving as a reception portion 22 for receiving the male connector 10. Although not shown in the drawings, a plurality of terminal receiving chambers are provided at a lower portion of the housing 21, and also male terminals, corresponding to the female terminals in the male connector 10, are received respectively in these terminal receiving chambers. These male terminals project into the interior of the reception portion 22.

Opposed insertion holes 23*a* and 23*b*, as well as opposed insertion holes 23*c* and 23*d*, are formed respectively through opposite end walls of the housing 21.

The insertion holes 23*a*, 23*b*, 23*c* and 23*d* have a shape generally equal to the cross-sectional shape of opposite side walls 31 and 32 of the slider 30, and the distance between the adjacent insertion holes 23*a* and 23*c*, as well as the distance between the adjacent insertion holes 23*b* and 23*d*, is generally equal to the distance between the opposite side walls 31 and 32 of the slider 30.

The side wall 31 of the slider 30 is passed through the insertion holes 23*a* and 23*b*, and the side wall 32 of the slider 30 is passed through the insertion holes 23*c* and 23*d*.

A hook-shaped engagement pawl 24 is formed on that portion of the housing 21 disposed near to the insertion hole 23*d*. The function of the engagement pawl 24 will be described later.

Notches 25*a* and 25*b* are formed in a peripheral edge of an open end of the reception portion 22 of the housing 21, and are disposed out of registry with each other. The notches 25*a* and 25*b* correspond respectively to the cam projections 13*a* and 13*b* formed respectively on the opposite side walls of the male connector 10.

Figure 2:
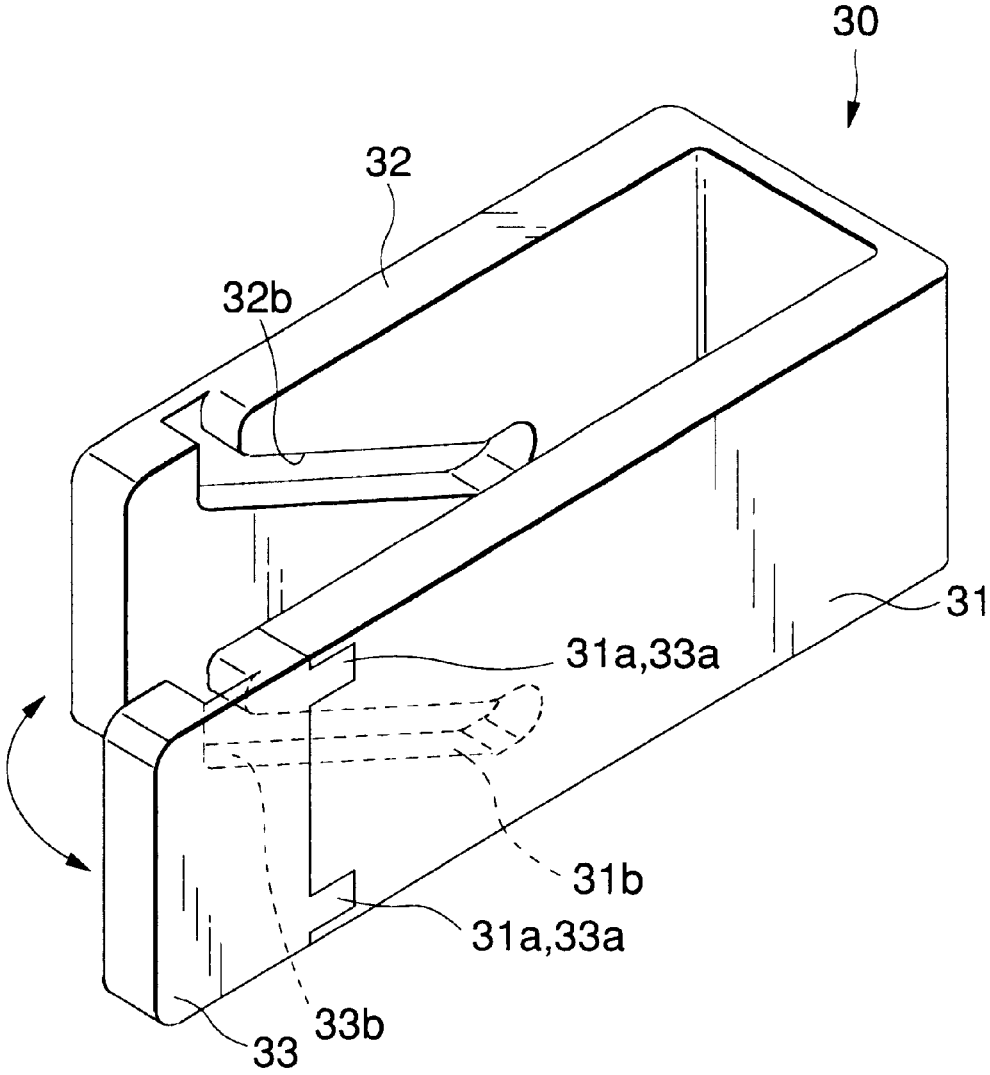
FIG. 2 is a perspective view of a slider of the LIF connector.

In FIGS. 1 and 2, the slider 30 includes a plate member of a generally U-shape. As described above, the slider 30 includes the two opposed side walls 31 and 32. The slider 30 further includes a lock portion 33, which is movable in a direction of an arrow, is pivotally mounted on a distal end of the side wall 31 through shafts 31*a* and 31*a* and bearings 33*a* and 33*a*.

The lock portion 33 has a height, a width and a cross-sectional shape which are equal to the side wall 31. When the lock portion 33 is held in its extended condition as shown in FIG. 2, the lock portion 33 extends from the distal end of the side wall 31 to be substantially equal to an extension of the side wall 31.

The side wall 31 is longer than the side wall 32 by its distal end portion at which the shafts 31*a* and 31*a* are formed. When the side wall 31, having the lock portion 33, and the side wall 32 are completely inserted into the housing 21, the lock portion 33 and the bearings 33*a* and 33*a* are projected from the insertion hole 23*b*.

Slanting cam grooves 33*b* and 31*b* are formed respectively in inner surfaces of the lock portion 33 and the side wall 31 in continuous relation to each other. A cam groove 32*b*, similar to the cam grooves 33*b* and 31*b*, is formed in an inner surface of the side wall 32, and is disposed out of registry with the cam grooves 33*b* and 31*b*.

The cam grooves 33*b* and 31*b* correspond to the cam projection 13*a* on the male connector 10, and have a width generally equal to the diameter of the cam projection 13*a*. The cam groove 32*b* corresponds to the cam projection 13*b* on the male connector 10, and has a width generally equal to the diameter of the cam projection 13*b*.

Figure 3:
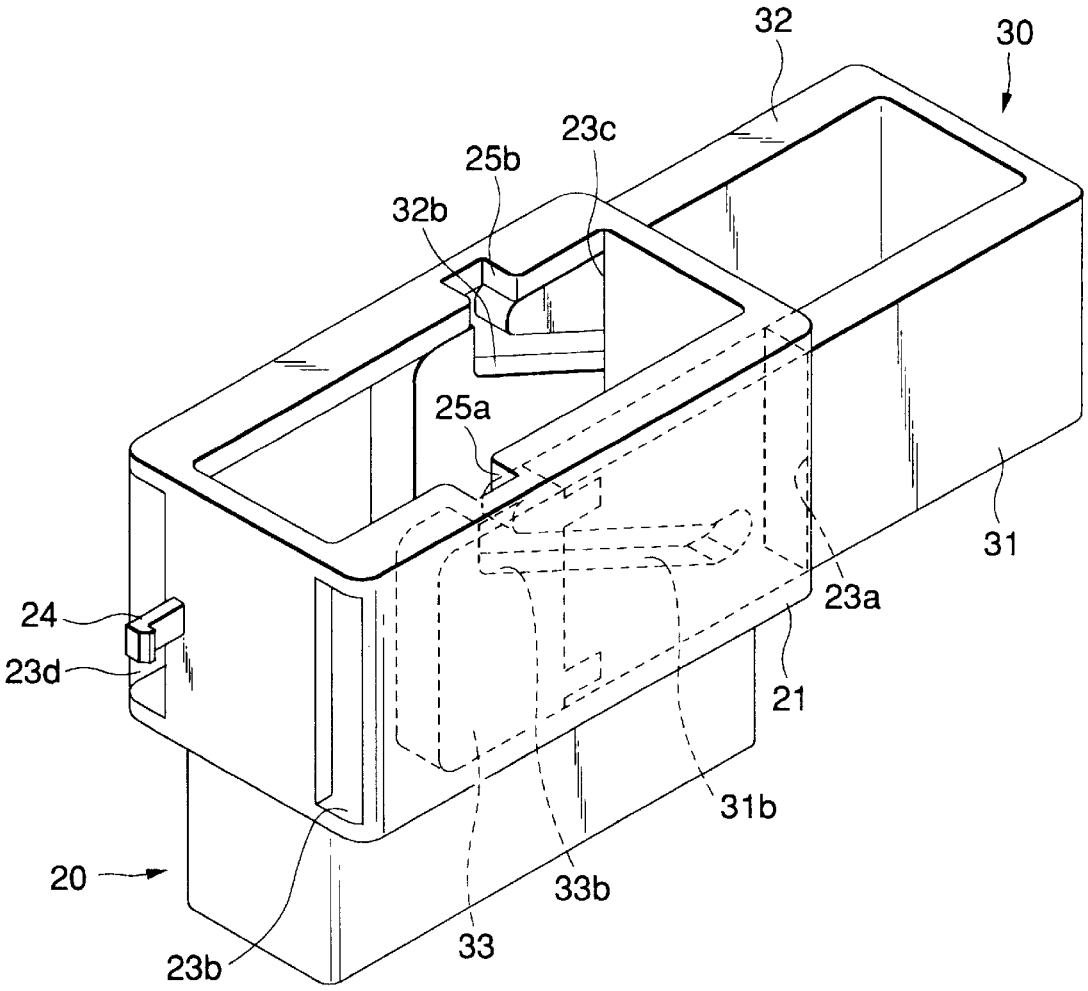
FIG. 3 is a perspective view showing a condition in which the slider is inserted halfway into a female connector.
Figure 4:
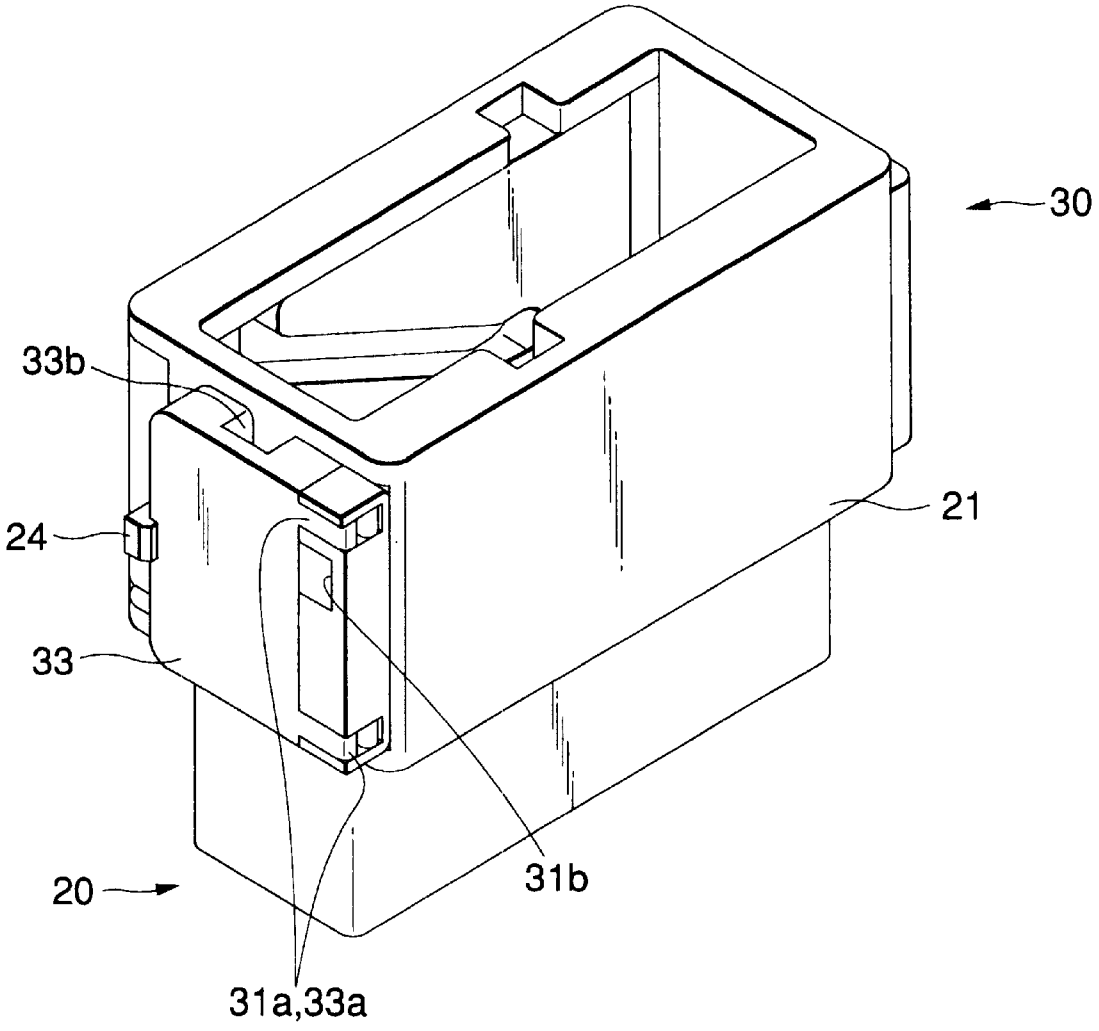
FIG. 4 is a perspective view showing an assembly comprising the slider and the female connector.
Figure 5:
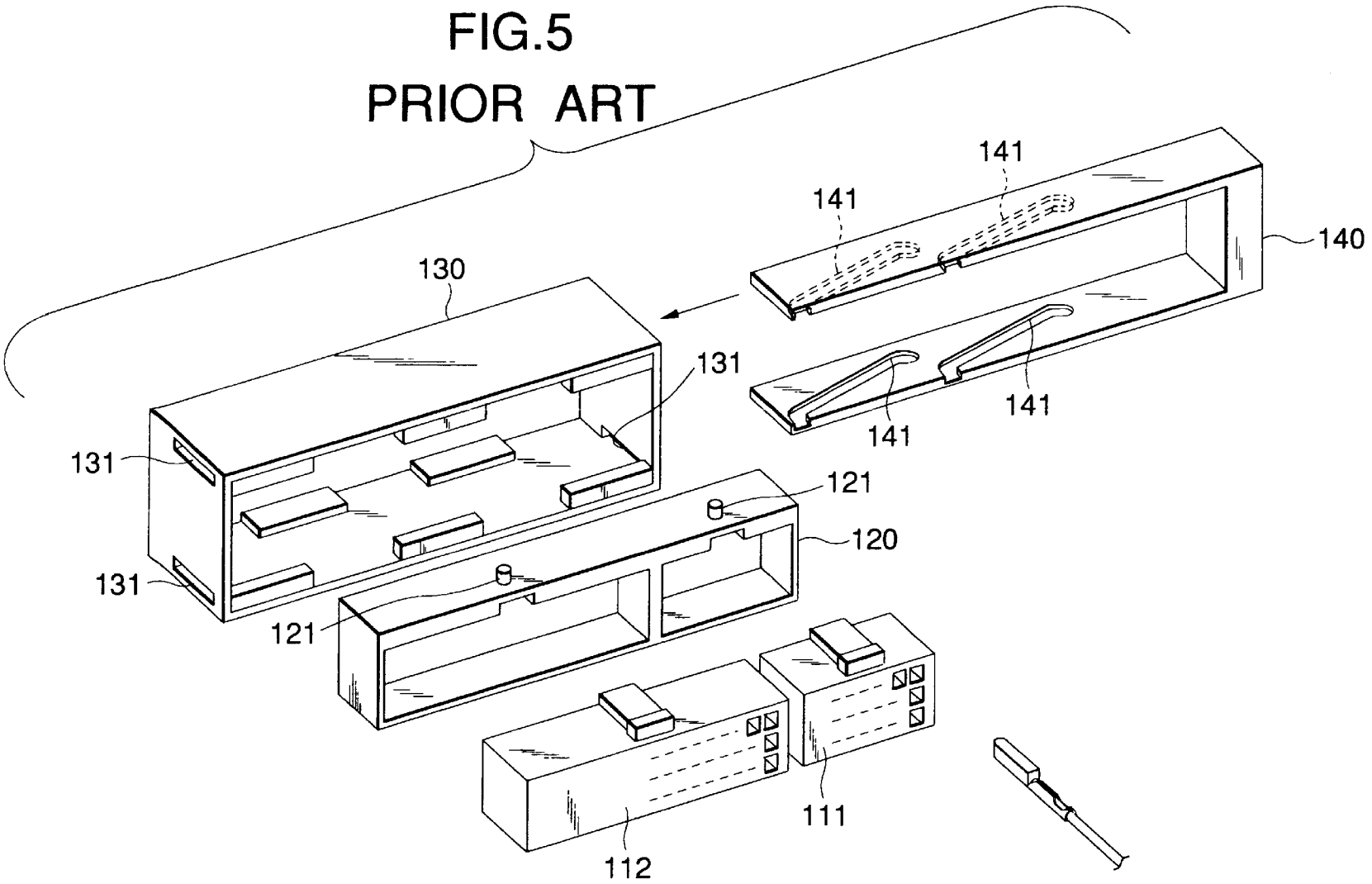
FIG.5 PRIOR ART
FIG. 5 is an exploded, perspective view showing a conventional LIF connector.

The function of the above lock portion will be described with reference to FIGS. 2, 3 and 4.

When the slider 30 is to be inserted into the female connector 20, the lock portion 33 of the slider 30 is held in the extended condition as shown in FIG. 2.

Then, the slider 30 is inserted into the housing 21 of the female connector 20 through the insertion holes 23*a* and 23*c*. At this time, the slider 30 is free to move into and out of the housing 21 as in the conventional construction.

Thereafter, when the slider 30 is completely inserted into the housing 21, the lock portion 33 and the bearings 33*a* and 33*a* project from the insertion hole 23*b*. Then, the projected lock portion 33 is turned to be laid flat against the housing 21, as shown in FIG. 4.

The lock portion 33 thus laid engages the engagement pawl 24 of the housing 21, and is held in this laid condition.

Accordingly, the slider 30 is locked to the housing 21, thereby providing the assembly comprising the slider 30 and the female connector 20.

For inserting the male connector 10 (see FIG. 1) into the female connector 20, the engagement of the lock portion 33 with the engagement pawl 24 is released, and the lock portion 33 is brought into the extended condition. Then, by sliding the slider 30, the open ends of the cam grooves 33*b* and 32*b* are positioned relative to the notches 25*a* and 25*b*, respectively (see FIG. 3).

Then, the cam projections 13*a* and 13*b* of the male connector 10 are introduced respectively into the open ends of the cam grooves 33*b* and 32*b* through the notches 25*a* and 25*b*, and then the slider 30 is pushed. In accordance with the movement of the slider 30, the male connector 10 is inserted into the female connector 20.

After the slider 30 is thus completely inserted, the lock portion 33 is brought into the laid condition, thereby maintaining the connection between the male and female connectors 10 and 20.

For withdrawing the male connector 10 from the female connector 20, the engagement between the lock portion 33 and the engagement pawl 24 is released, and the lock portion 33 is brought into the extended condition. Then, the lock portion 33 is pushed into the housing 21, and accordingly the slider 30 is slid in a direction (withdrawing direction) opposite to the above-mentioned direction, so that the male connector 10 can be disconnected from the female connector 20.

In the LIF connector of this embodiment, by bringing the lock portion 33 into the laid condition, the slider 30, inserted in the female connector 20, can be locked to the female connector 20, and therefore the assembly, comprising the slider 30 and the female connector 20, can be handled easily. Therefore, the loss and damage of the slider 30, as well as the generation of noises, during the transport of the assembly, are positively prevented.

Since the engagement pawl 24 for engagement with the lock portion 33 in the laid condition is provided on the housing 21 of the female connector 20, the lock portion 33 can be held in the locked condition, and the accidental disengagement of the slider 30 can be prevented.

When the male connector 10 is to be withdrawn from the female connector 20, the lock portion 33 in the extended condition is pushed into the housing 21, and by doing so, the connection between the male and female connectors 10 and 20 can be easily released.

That is, in the LIF connector of this embodiment, the insertion and withdrawal of the male connector 10 can be effected by pushing the slider 30 into the female connector 20.

The LIF connector of the present invention is not limited to the above embodiment.

For example, in the above embodiment, although the lock portion 33 is mounted only on one side wall 31 of the slider 30, the lock portions may be mounted respectively on the two side walls 31 and 32 of the slider 30.

In such a construction, the slider 30 can be more firmly locked, and besides when withdrawing the male connector 10, the pushing force can be applied uniformly to the slider 30 by pushing the two lock portions, and therefore the slider 30 can be more smoothly slid.

As described above, in the LIF connector of the present invention, the slider has the locking mechanism for locking the slider to the female connector, and therefore the assembly, comprising the slider and the female connector, can be handled easily, and also the loss and damage of the slider, as well as the generation of noises, are positively prevented.

I claim:

1. A low insertion force connector, comprising:

a first connector including a first housing having cam projections formed on side surfaces thereof;

a second connector including a second housing having a reception portion into which the first connector is insertable; and a slider including a base portion, and a pair of opposed side walls extending from end portions of the base portion, the opposed side walls being slidably insertable into the second housing of the second connector, the opposed side walls having cam grooves which respectively guide the cam projections so that the first connector is inserted into the second connector in accordance with movement of the slider;

wherein at least one of the opposed side walls has a lock portion that is pivotably connected to a distal end portion thereof for locking said slider in the second housing when in a predetermined locked position.

2. The low insertion force connector of claim 1, wherein the slider is locked to the second connector when the lock portion is pivoted after the lock portion is longitudinally projected from the housing of the second connector.

3. The low insertion force connector of claim 2, further comprising an engagement pawl formed on the housing of the second connector so as to retain the lock portion which is pivoted.

4. The low insertion force connector of claim 1, wherein the lock portion has a cam groove portion which aligns with one of the cam grooves of said opposed side walls when said lock portion is projected longitudinally therefrom.

5. The low insertion force connector of claim 4, wherein when the cam groove portion aligns with one of the cam grooves, the second cam groove associates with the other one of the cam grooves so that the first connector is inserted into the second connector in accordance with the movement of the slider.

6. The low insertion force connector of claim 5, wherein the cam groove portion and the other one of the cam grooves have open ends, and wherein the first connector is inserted into the second connector in accordance with the movement of the slider after introducing the cam projections of the first connector into the open ends.

7. The low insertion force connector of claim 1, wherein the second housing of the second connector includes a first wall having a pair of first through holes and a second wall having a pair of second through holes, said first wall opposing said second wall, and wherein the opposed side walls are slidably insertable into the first through holes and the second through holes.

8. The low insertion force connector of claim 1, wherein said lock portion is moveable from an unlocked position to said locked position.

9. The low insertion force connector of claim 8, wherein in said unlocked position said lock portion extends from and is substantially coplanar with said at least one side wall so as to be receivable in the second housing of said second connector.

10. The low insertion force connector of claim 9, wherein said slider is insertable into said second housing from a first side thereof, and wherein in said locked position said lock portion is locked on a second side of said second housing opposite said first side.

11. The low insertion force connector of claim 10, wherein in said locked position said lock portion is parallel to said second side of said housing.

* * * * *